US006468719B1

(12) United States Patent
Hsu et al.

(10) Patent No.: US 6,468,719 B1
(45) Date of Patent: Oct. 22, 2002

(54) METHOD OF FABRICATING A FRONT SUBSTRATE FOR AC PLASMA DISPLAY PANEL

(75) Inventors: Sheng-Wen Hsu, Taipei (TW); Kuang-Lang Chen, Taipei (TW); Shiuh-Bin Kao, Taipei (TW); Ching-Hui Lin, Taipei (TW)

(73) Assignee: Chunghwa Picture Tubes, Ltd., Taipei (TW)

( * ) Notice: Subject to any disclaimer, the term of this patent is extended or adjusted under 35 U.S.C. 154(b) by 0 days.

(21) Appl. No.: 09/516,229

(22) Filed: Mar. 1, 2000

(51) Int. Cl.[7] ..... H01J 9/02

(52) U.S. Cl. ..... 430/321; 430/314; 430/319; 445/24

(58) Field of Search ..... 430/314, 319, 430/321; 445/24; 313/582, 584, 586, 587

(56) References Cited

U.S. PATENT DOCUMENTS 6,326,727 B1 * 12/2001 Chung ..... 313/586

* cited by examiner

*Primary Examiner*—John A. McPherson
(74) *Attorney, Agent, or Firm*—Bacon & Thomas

(57) ABSTRACT

A front panel for AC plasma display panel made by: using exposure and sand blast techniques to form horizontally spaced lines of induction layer above an inner side of a glass substrate, and then making X-electrodes and Y-electrodes on the glass substrate, enabling X-electrodes and Y-electrodes to be alternatively disposed and horizontally spaced between each two adjacent lines of induction layer, and then printing a protective layer over the electrodes, enabling a straight line of discharge path to be formed between each X-electrode and Y-electrode, so that the service life of the plasma display panel can be prolonged, the intensity of electric field and UV light can be greatly improved, and the value of driving voltage can be effectively reduced.

11 Claims, 9 Drawing Sheets

METHOD OF FABRICATING A FRONT SUBSTRATE FOR AC PLASMA DISPLAY PANEL

BACKGROUND OF THE INVENTION

The present invention relates to a front substrate for AC plasma display panel, and more particularly to such a front substrate in which each X-electrode and Y-electrode have a respective discharge side facing to each other and arranged in parallel, defining therebetween a straight discharge path. The invention relates also to the fabrication of such a front substrate.

In the fabrication of a conventional AC plasma display panel 10, as shown in FIG. 1, a front substrate 11 and a rear substrate 12 are arranged in parallel and encapsulated, and a gas mixture containing Ne and Xe is sealed in the discharging space between the substrates. The front substrate 11 comprises parallel transparent electrodes 111 arranged on its inner side, parallel sub electrodes 112 respectively arranged on the transparent electrodes 111, an induction layer 113 covered over the electrodes 111 and 112, and a protective layer 114 covered on the induction layer 113. The rear substrate 12 comprises a plurality of data electrodes 121 arranged in parallel on its inner side, an induction layer 124 covered over the data electrodes 121, parallel lines of partition wall 122 arranged on the induction layer 124 and extended to the protective layer 114 at the front substrate 11, and fluorescent body 123 covered on the induction layer 124 around the lines of partition wall 122. When electric voltage is applied to the electrodes 111, 112 and 121, electricity is discharged in the cells 13 between the induction layers 113 and 124, causing the fluorescent body 123 to emit the corresponding color of light. In the fabrication of the front substrate 11 of the aforesaid AC plasma display panel 10, a photolithography or printing technique is used to make transparent electrodes 111 on the inner side of the front substrate 11, and steam-plating and photolithography techniques are used to form sub electrodes 112 on the transparent electrodes 111 to reduce the line impedance of the transparent electrodes 11. In the following description, X-electrode and Y-electrode are used to represent each two adjacent transparent electrodes 111 (including the corresponding sub electrodes 112) on the front substrate 11. The two electrodes act with one data electrode 121 at the rear substrate 12, enabling the induction layers 113 and 124 to discharge electricity into the corresponding cell 13. In the aforesaid front substrate 11, the equivalent circuits formed upon discharging of the X-electrodes and Y-electrodes are as shown in FIG. 2, in which Cg is gas-filled capacitor, Cd is induction layer capacity, $Cs_1$ and $Cs_2$ are stray capacity produced in the glass substrate 11 and the induction layer 113. The equivalent circuits can be simplified into a parallel circuit formed of capacities Cg and Cd and capacities $Cs_1$ and $Cs_2$ and connected between the X-electrode and Y-electrode as shown in FIG. 3. In the aforesaid X and Y electrodes design, the discharging sides of the electrodes are almost arranged on the same level, and the discharging paths are presented in an arch shape. This design has the following drawbacks.

1. Uneven distribution of electric field: As shown in FIG. 4, the intensity of the electric field becomes stronger at the center area between the X-electrode and the Y-electrode, causing a relatively better discharging effect and a stronger intensity of UV light to be produced at the center area between the X-electrode and the Y-electrode.

2. Complicated equivalent circuits being not easy to be driven: As illustrated in FIG. 5, different equivalent circuits are produced subject to different discharging paths, and the equivalent circuits formed of the gas-filled capacity Cg and the induction layer capacity Cd cannot be simplified after driving of the electrodes.
3. Limited operation range of driving voltage: Because different discharging paths have different V-I curves, as shown in FIG. 6, memory margin is relatively limited to the plasma display panel.
4. False discharge due to uneven accumulation of electric discharges: Because the intensity of electric field is relatively stronger at the center area between the X-electrode and the Y-electrode, space charge tends to be gathered at the electrodes near the center area, as shown in FIG. 7, inviting a false discharge.

SUMMARY OF THE INVENTION

The present invention has been accomplished to provide a front substrate for AC plasma display panel, which eliminates the aforesaid problems. It is one object of the present invention to provide a front substrate for AC plasma display panel, which enables the discharging sides of each X-electrode and Y-electrode to be disposed in parallel for producing a uniform electric field and electric plasma to prevent striking of ions against the fluorescent layer on the rear substrate of the plasma display panel, so as to improve the surface life of the plasma display panel. It is another object of the present invention to provide a front substrate for AC plasma display panel, which keeps the discharge paths in the electrodes to be maintained in straight, so as to greatly improve the intensity of the electric field and UV light, and to effectively reduce the driving voltage value. It is still another object of the present invention to provide a front substrate for AC plasma display panel, which enables same equivalent circuits to be produced corresponding to the discharge paths when the electrodes are driven. It is still another object of the present invention to provide a front substrate for AC plasma display panel, which enables electric charges to be evenly accumulated at the electrodes to fix the range of memory effect, so as to prevent a false discharge due to a potential turbulence.

DETAILED DESCRIPTION OF THE PREFERRED EMBODIMENT

Figure 1:
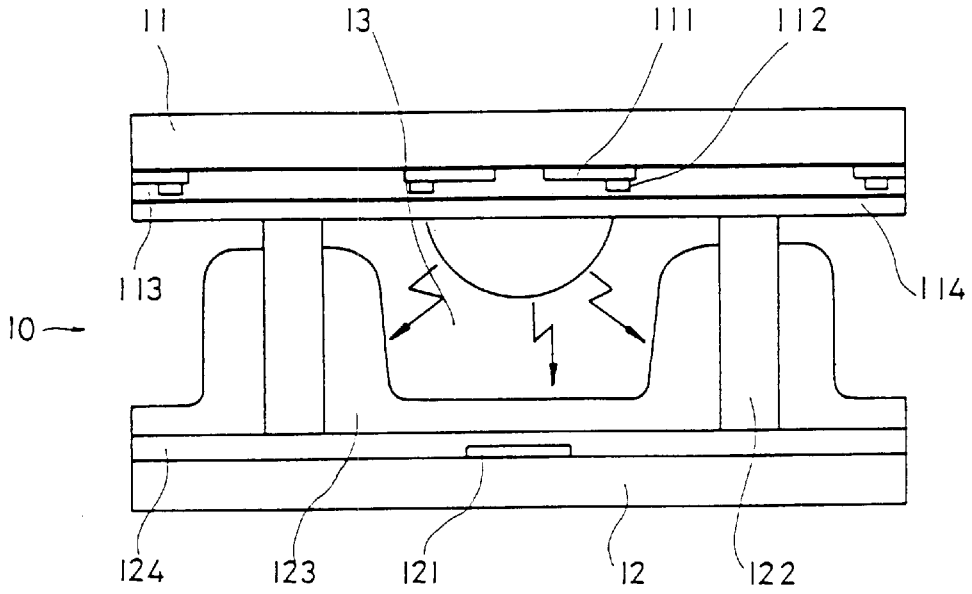
Fig. 1 Prior art
FIG. 1 is a schematic drawing showing the structure of a conventional plasma display panel.
Figure 2:
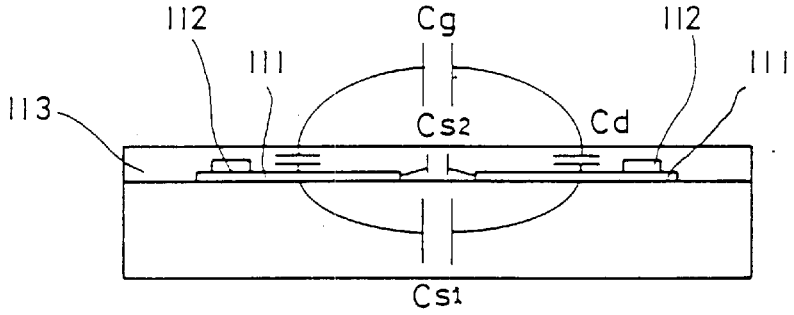
Fig. 2 Prior art
FIG. 2 is a schematic drawing illustrating an equivalent circuit of a front substrate for a conventional plasma display panel.
Figure 3:
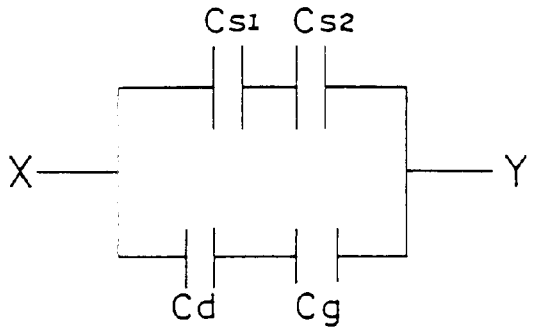
Fig. 3 Prior art
FIG. 3 is a simplified circuit diagram obtained from FIG. 2.
Figure 4:
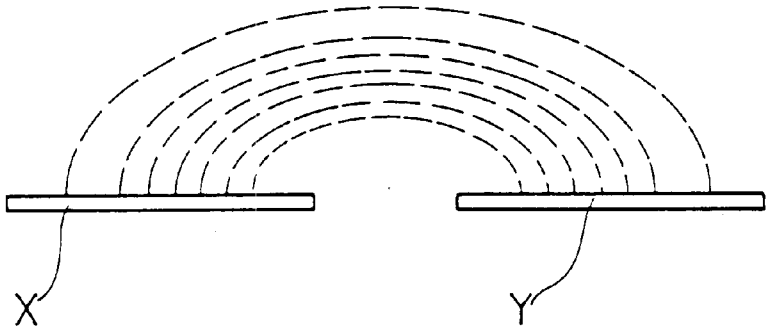
Fig. 4 Prior art
FIG. 4 illustrates a discharge status between the X-electrode and Y-electrode according to the front substrate shown in FIG. 2.
Figure 5:
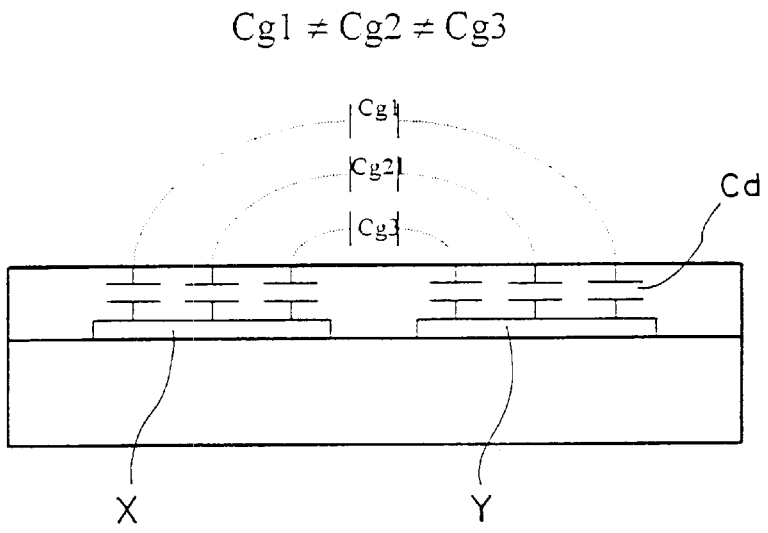
Fig. 5 Prior art
FIG. 5 is a schematic drawing illustrating equivalent circuits at different discharge paths in the front substrate shown in FIG. 2.
Figure 6:
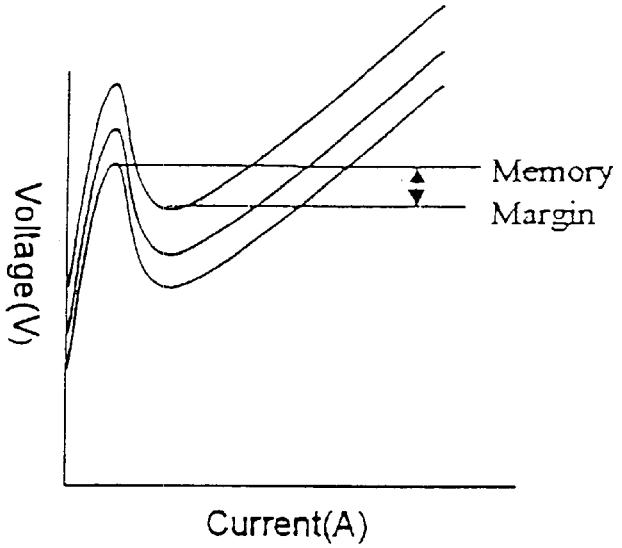
Fig. 6 Prior art
FIG. 6 is a voltage-current curve obtained from the front substrate shown in FIG. 2.
Figure 7:
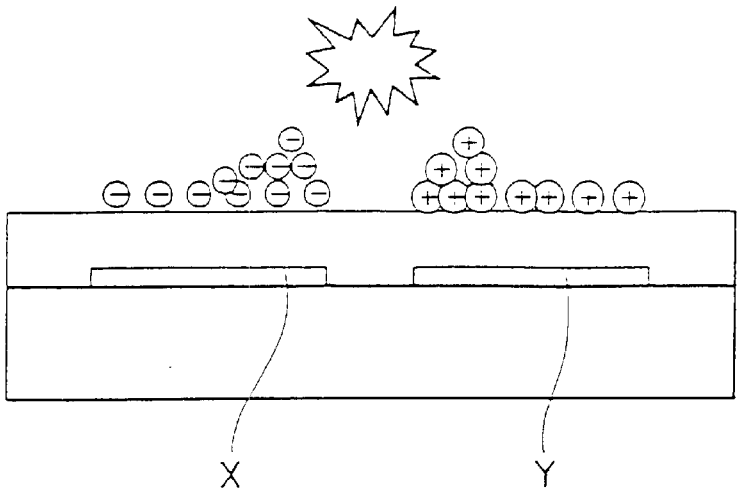
Fig. 7 Prior art
FIG. 7 is a schematic drawing showing electric charges accumulated on the top sidewall of the front substrate shown in FIG. 2.
Figure 8:
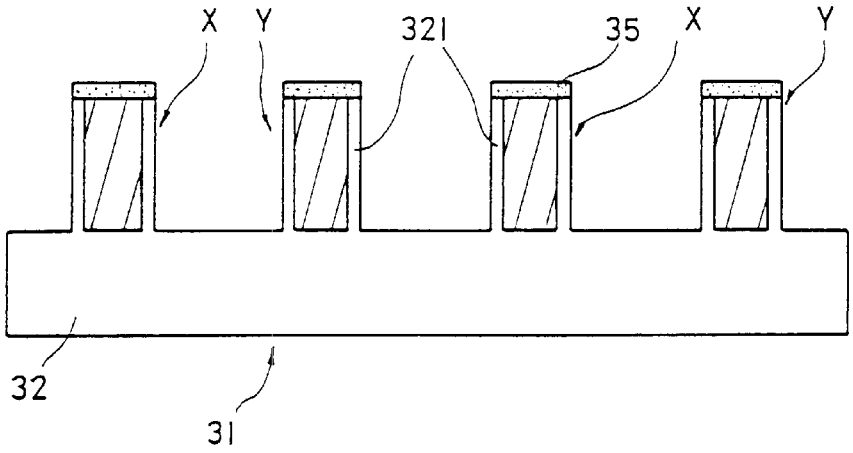
FIG. 8 is a schematic drawing showing the structure of a front substrate for an AC plasma display panel according to the present invention.

Referring to FIG. 8, a front substrate 31 for an AC plasma display panel in accordance with the present invention comprises a glass substrate 32, lines of thin-film induction layer 321 perpendicularly raised from an inner side of the glass substrate 32 and horizontally spaced from one another, X-electrodes and Y-electrodes respectively printed on the glass substrate 32 at two opposite lateral sides of each line of thin-film induction layer 321, and a protective layer 35 printed on the electrodes and the lines of thin-film induction layer 321 at a top side. Because X-electrodes and Y-electrodes are perpendicularly extended from one side of the glass substrate 32 and alternatively arranged in parallel between each two adjacent lines of thin-film induction layer 321, each adjacent X-electrode and Y-electrode have a respective discharge side facing to each other and arranged in parallel, defining therebetween a straight discharge path.

Figure 9:
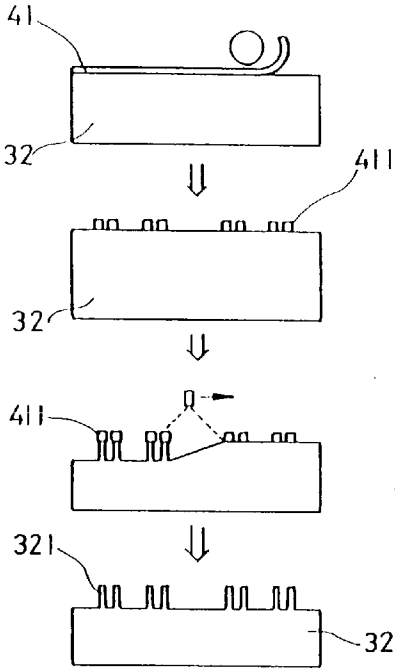
FIG. 9 illustrates the fabrication flow of the front substrate according to the present invention.

Before the formation of the X-electrodes and Y-electrodes on the front substrate 31, as shown in FIG. 9, a dry film photoresist 41 is adhered to an inner side of the glass substrate 32, and then a photo mask is used and an exposure procedure is performed, enabling horizontally spaced lines of solidified layer 411 to be formed on the dry film photoresist 41, and then the residual dry film photoresist is removed from the glass substrate 32, and then the area of the glass substrate 32 outside the lines of solidified layer 411 is lithographed by sand blast, and thus horizontally spaced lines of thin-film induction layer 321 are formed on the glass substrate 32 after removal of the lines of solidified layer 411.

Figure 10:
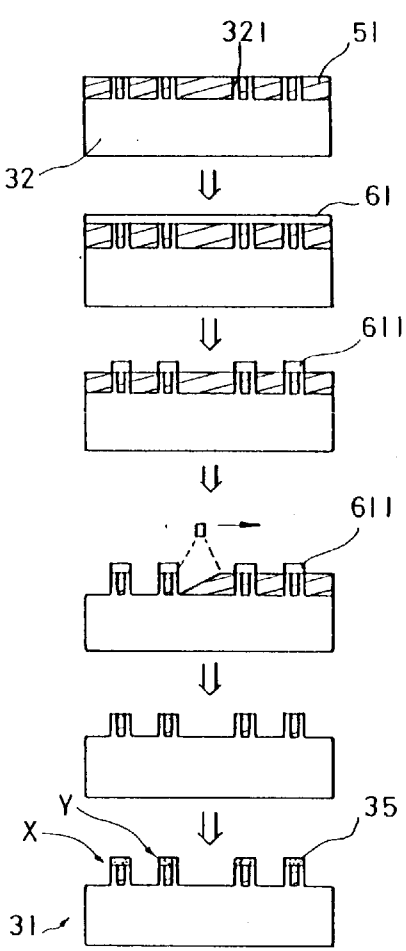
FIG. 10 illustrates the X and Y electrodes fabrication flow according to one fabrication example of the present invention.

According to one fabrication example of the present invention, a layer of electrode 51 is printed on an inner side of a glass substrate 32 and filled up the space between each two adjacent lines of thin-film induction layer 321 after the formation of the lines of thin-film induction layer 321 on the glass substrate 32, and then a dry film photoresist 61 is adhered to the lines of thin-film induction layer 321, and then a photo mask is used and an exposure procedure is performed, enabling horizontally spaced lines of solidified layer 611 to be formed on the dry film photoresist 41 corresponding to the designed locations for X-electrodes and Y-electrode, and then the residual dry film photoresist 41 is removed from the glass substrate 32, and then the area of the layer of electrode 51 which is not protected by the lines of solidified layer 611 is removed from the glass substrate 32 by sand blast, and then the lines of solidified layer 611 is removed, and then a protective layer 35 is printed on the remaining layer of electrode 51, and thus horizontally spaced lines of X-electrodes and Y-electrodes are formed on the glass substrate 32 (see FIG. 10).

Figure 11:
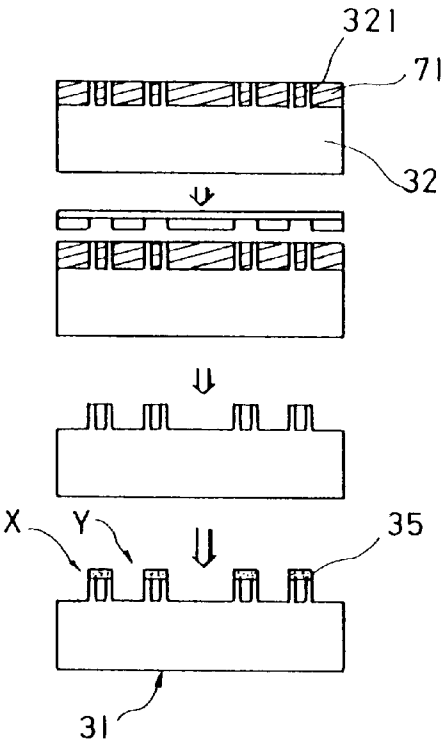
FIG. 11 illustrates the X and Y electrodes fabrication flow according to another fabrication example of the present invention.

According to another fabrication example of the present invention, a layer of photosensitive electrode 71 is printed on an inner side of a glass substrate 32 and filled up the space between each two adjacent lines of thin-film induction layer 321 after the formation of the lines of thin-film induction layer 321 on the glass substrate 32, and then a photo mask is used and an exposure procedure is performed, enabling the layer of photosensitive electrode 71 to be solidified at locations between each two adjacent lines of thin-film induction layer 321 corresponding to designed X-electrodes and Y-electrodes, enabling X-electrodes and Y-electrodes to be formed on the glass substrate 32 after removal of the non-exposure area of the layer of photosensitive electrode, and then a protective layer 35 is printed on the X-electrodes and Y-electrodes (see FIG. 11).

Figure 12:
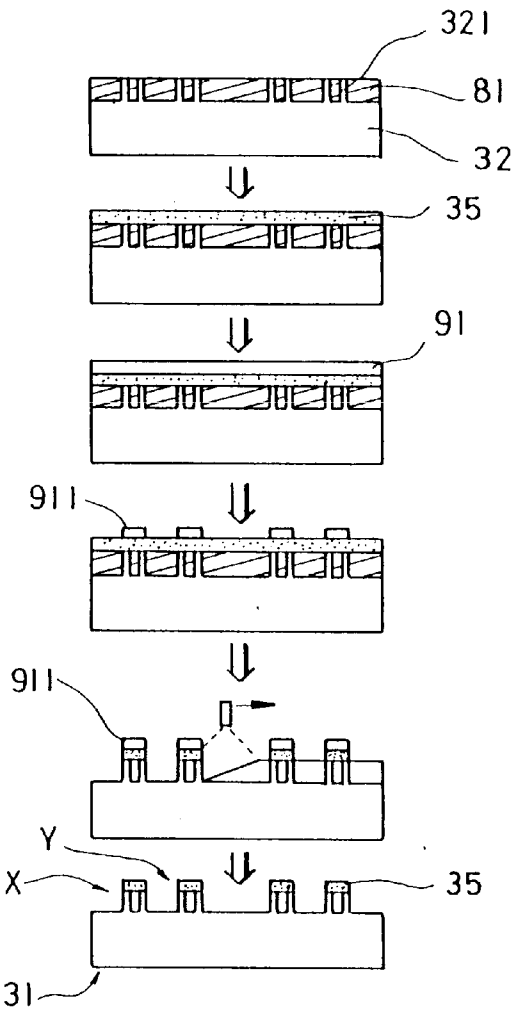
FIG. 12 illustrates the X and Y electrodes fabrication flow according to still another fabrication example of the present invention.

According to still another fabrication example of the present invention, a layer of electrode 81 is printed on an inner side of a glass substrate 32 and filled up the space between each two adjacent lines of thin-film induction layer 321 after the formation of the lines of thin-film induction layer 321 on the glass substrate 32, and then a protective layer 35 is printed on the layer of electrode 81, and then a dry film photoresist 91 is adhered to the layer of electrode 81, and then a photo mask is used and an exposure procedure is performed, enabling horizontally spaced lines of solidified layer 911 to be formed on the dry film photoresist 91 in between each two adjacent lines of thin-film induction layer 321 corresponding to designed locations for X-electrodes and Y-electrodes, and the non-exposure area of the dry film photoresist 91 is removed, and then the protective layer 35 and the layer of electrode 81 beyond the lines of solidified layer 911 are removed, an then the lines of solidified layer 911 are removed, and a front substrate 31 is thus finished (see FIG. 12).

Figure 14:
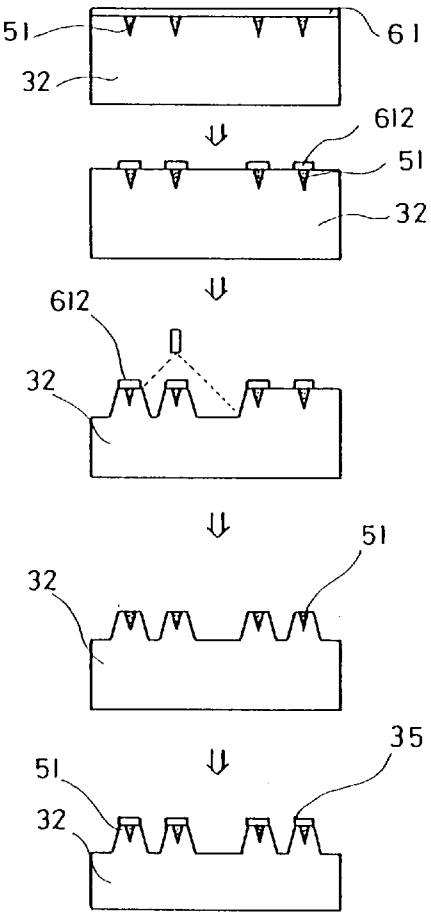
FIG. 14 illustrates the front substrate fabrication flow after the procedure shown in FIG. 13.

According to still another fabrication example of the present invention, a dry film photoresist 41 is adhered to an inner side of the glass substrate 32, and then a photo mask is used and an exposure procedure is performed, enabling horizontally spaced lines of solidified layer 412 to be formed on the dry film photoresist 41, and then the non-exposure area of the dry film photoresist 41 is removed, and then a sand blast lithographing procedure is performed on the glass substrate 32 over the area not protected by the solidified layer, and then the lines of solidified layer 412 are removed, enabling horizontally spaced lines of electrode grooves 322 to be formed on the glass substrate 32, and then a layer of electrode 51 is printed on the glass substrate 32 and filled up the electrode grooves 322 (see FIG. 13), and then a dry film photoresist 61 is adhered to the layer of electrode 51, and then a photo mask is used and an exposure procedure is performed, enabling horizontally spaced lines of solidified layer 612 to be formed on the dry film photoresist 61 at locations corresponding to the designed X-electrodes and Y-electrodes, and then the non-exposure area of the dry film photoresist 61 is removed, and then a sand blast lithographing procedure is performed on the glass substrate 32 over the area not protected by the solidified layer, and then the lines of solidified layer 612 are removed, and then a protective layer 35 is printed on the lines of electrode layer 51, and horizontally spaced X-electrodes and Y-electrodes are thus formed on the glass substrate 32 (see FIG. 14).

Figure 15:
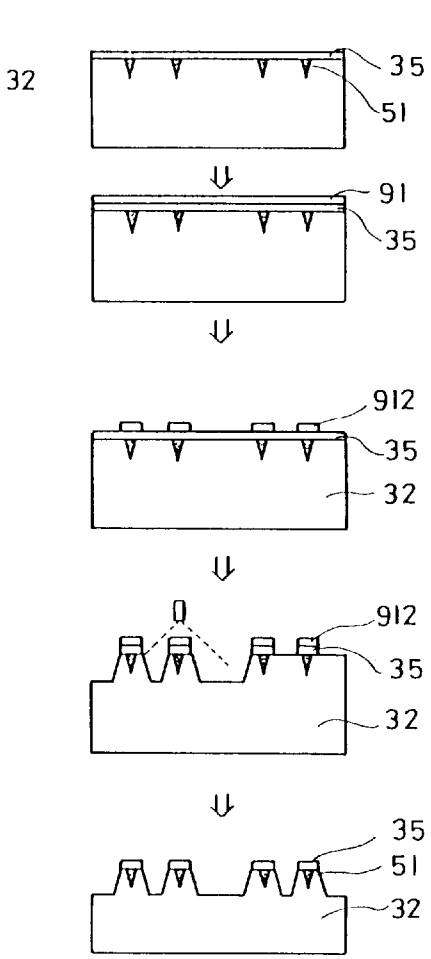
FIG. 15 illustrates another front substrate fabrication flow after the procedure shown in FIG. 13.
Figure 13:
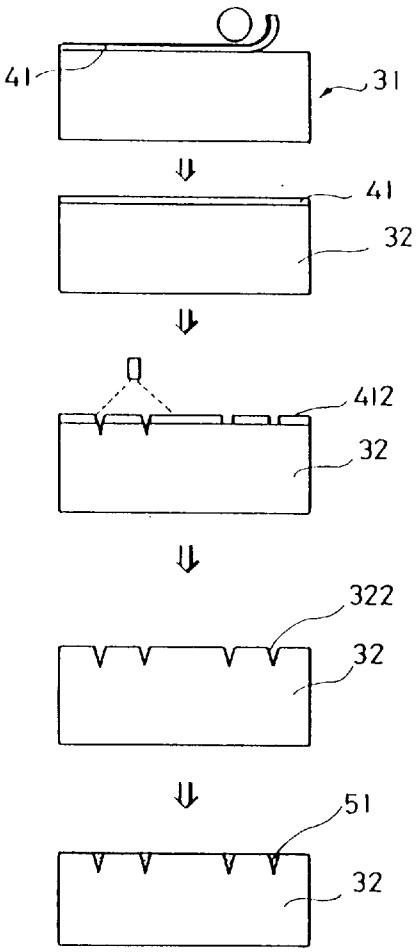
FIG. 13 illustrates the X and Y electrodes fabrication flow according to still fabrication example of the present invention.

In still another fabrication example of the present invention, a protective layer 35 is printed on an inner side of the glass substrate 32 after the procedure of printing a layer of electrode 51 over the electrode grooves 322 as performed in the fabrication example shown in FIGS. 13 and 14, and then a dry film photoresist 91 is adhered to the protective layer 35, and then a photo mask is used and an exposure procedure is performed, enabling horizontally spaced lines of solidified layer 912 to be formed on the dry film photoresist 91 at locations for the designed X-electrodes and Y-electrodes, and then the non-exposure area of the dry film photoresist 91 is removed, and then a sand blast lithographing procedure is performed on the glass substrate 32 over the area not protected by the protective layer 35; and then the lines of solidified layer 912 are removed, and a front substrate is thus finished (see FIG. 15).

Figure 17:
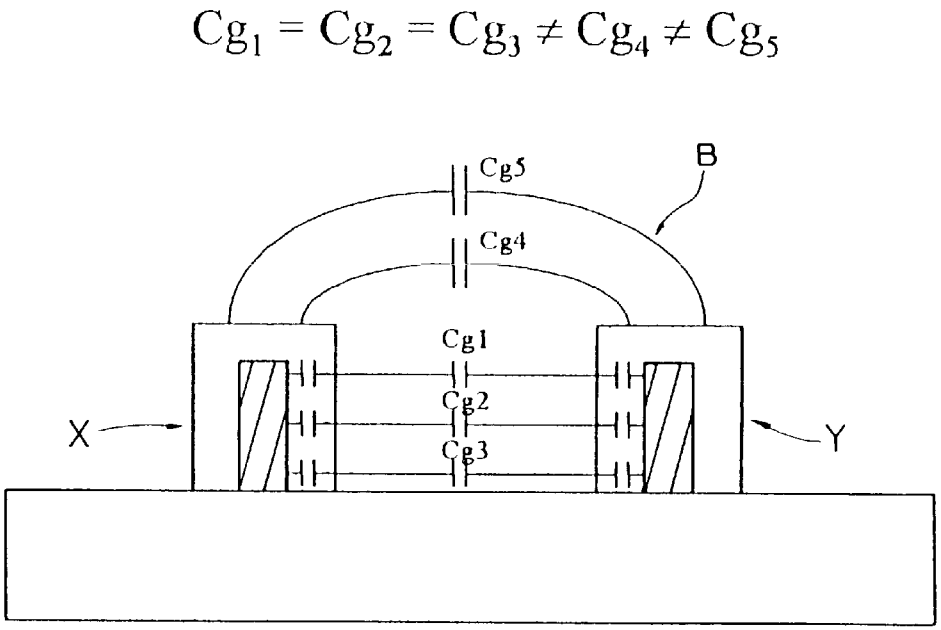
FIG. 17 is a schematic drawing showing the presence of equivalent circuit corresponding to respective discharge path according to the present invention.
Figure 16:
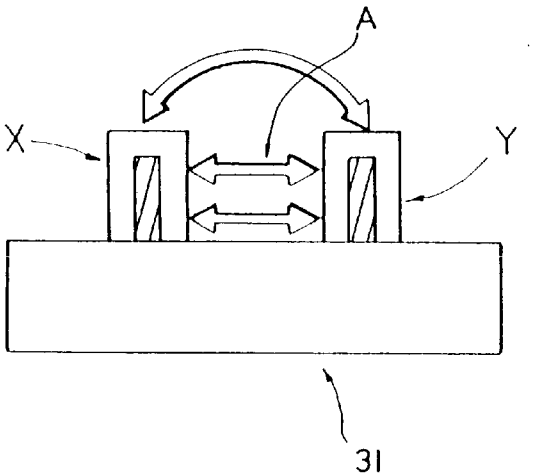
FIG. 16 is a schematic drawing showing the discharge path between one X-electrode and the adjacent Y-electrode according to the present invention.
Figure 19:
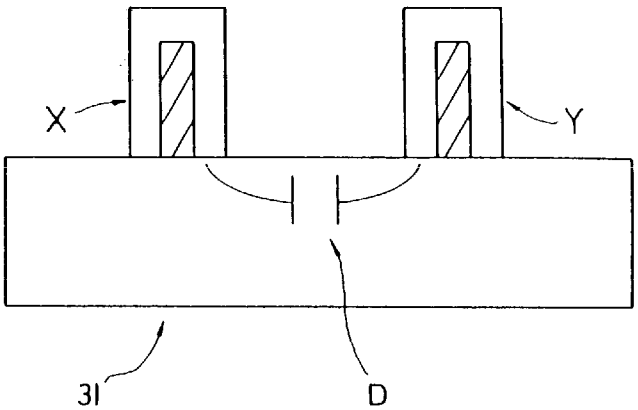
FIG. 19 is a schematic drawing showing the distribution of stray capacity in the glass substrate and the induction layer according to the present invention.
Figure 18:
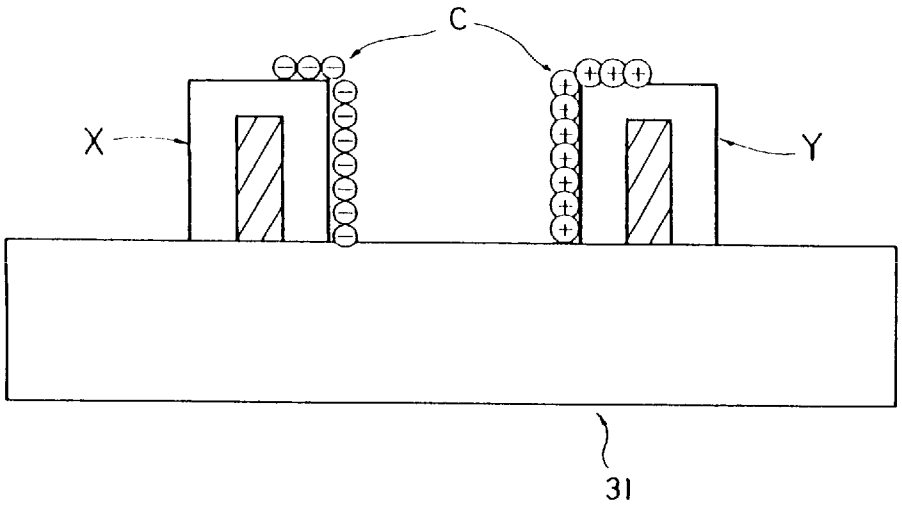
FIG. 18 is a schematic drawing showing electric charges accumulated at the surface of the electrodes.

According to the aforesaid fabrication examples, a front substrate provides the following advantages:

1. Because the discharge path A between each X-electrode and Y-electrode is a straight line, uniform electric field and electric plasma are produced, preventing striking of ions against the fluorescent layer on the rear substrate. Therefore, the service life of the plasma display panel is prolonged, the intensity of electric field and UV light is greatly improved, and the value of driving voltage is effectively reduced.
2. The equivalent circuit B corresponding to the discharge path A is simplified upon driving of the electrodes (see FIG. 17).
3. Because accumulated wall charges C at the surface of the electrodes are uniform, as shown in FIG. 18, the range of memory effect is fixed, and false discharge due to potential turbulence is eliminated.
4. Because less stray capacity D is produced in the glass substrates and induction layer, displacement current is relatively reduced (see FIG. 19), and power consumption is low.

It is to be understood that the drawings are designed for purposes of illustration only, and are not intended for use as a definition of the limits and scope of the invention disclosed.

What the invention claimed is:

1. A method of fabricating a front substrate for AC plasma display panel by making horizontally spaced lines of electrodes on an inner side of a glass substrate, enabling each two adjacent lines of electrodes to have a respective discharge side facing to each other and defining a straight line of discharge path wherein horizontally spaced lines of induction layer are made perpendicularly raised from the inner side of said glass substrate by exposure and sand blast techniques before the formation of said electrodes, enabling said electrodes to be formed on said glass substrate and piled up at two opposite sides of each line of induction layer.

2. The method of fabricating a front substrate for AC plasma display panel according to claim 1, wherein lines of induction layer is made by adhering a dry film photoresist to the inner side of said glass substrate, and then using a photo mask to perform an exposure procedure, enabling horizontally spaced lines of solidified layer to be formed on said dry film photoresist.

3. The method of fabricating a front substrate for AC plasma display panel according to claim 2 wherein residual dry film photoresist is removed from said glass substrate after the formation of said lines of solidified layer, and then the area of said glass substrate outside said lines of solidified layer is lithographed by sand blast, enabling said horizontally spaced lines of thin-film induction layer to be formed on said glass substrate after removal of said lines of solidified layer.

4. The method of fabricating a front substrate for AC plasma display panel according to claim 1 wherein said electrodes are made by: printing a layer of electrode on said lines of induction layers, enabling said layer of electrode to fill up the space between each two lines of induction layer, and then adhering a dry film photoresist to said layer of electrode, and then using a photo mask to perform an exposure procedure, enabling horizontally spaced lines of solidified layer to be formed on said dry film photoresist corresponding to designed locations for X-electrodes and Y-electrode, and then removing residual dry film photoresist from said glass substrate, and then removing from said glass substrate the area of said layer of electrode which is not protected by said lines of solidified layer from the glass substrate by sand blast, and then removing said lines of solidified layer, and then printing a protective layer on the remaining layer of electrode, enabling the desired horizontally spaced lines of X-electrodes and Y-electrodes to be formed on said glass substrate.

5. The method of fabricating a front substrate for AC plasma display panel according to claim 1 wherein said electrodes are made by: printing a layer of photosensitive electrode on the inner side of said glass substrate and filled up the space between each two adjacent lines of thin-film induction layer after the formation of said lines of thin-film induction layer on said glass substrate, and then using a photo mask to perform an exposure procedure, enabling said layer of photosensitive electrode to be solidified at locations between each two adjacent lines of thin-film induction layer subject to designed X-electrodes and Y-electrodes, enabling X-electrodes and Y-electrodes to be formed on said glass substrate after removal of the non-exposure area of said layer of photosensitive electrode, and then printing a protective layer on the X-electrodes and Y-electrodes.

6. The method of fabricating a front substrate for AC plasma display panel according to claim 1 wherein said electrodes are made by: printing a layer of electrode on the inner side of said glass substrate to fill up the space between each two adjacent lines of thin-film induction layer after the formation of said lines of thin-film induction layer on said glass substrate, and then printing a protective layer on said layer of electrode, and then adhering a dry film photoresist to said layer of electrode, and then using a photo mask to perform an exposure procedure, enabling horizontally spaced lines of solidified layer to be formed on said dry film photoresist in between each two adjacent lines of thin-film induction layer subject to designed locations for X-electrodes and Y-electrodes, and then removing the non-exposure area of said dry film photoresist, and then removing the area of said protective layer and said layer of electrode beyond said lines of solidified layer, an then removing said lines of solidified layer.

7. The method of fabricating a front substrate for AC plasma display panel according to claim 1 wherein an exposure and sand blast procedure is performed to form horizontally spaced lines of electrode grooves above the inner side of said glass substrate before making said horizontally spaced lines of induction layer on said glass substrate.

8. The method of fabricating a front substrate for AC plasma display panel according to claim 7 wherein said exposure and sand blast procedure comprises the step of adhering a dry film photoresist to the inner side of said glass substrate, the step of using a photo mask to perform an exposure process, enabling horizontally spaced lines of solidified layer to be formed on said dry film photoresist.

9. The method of fabricating a front substrate for AC plasma display panel according to claim 8 wherein said exposure and sand blast procedure further comprises the step of removing the non-exposure area of said dry film photoresist, and the step of using sand blast to lithograph said glass substrate over the area not protected by said solidified layer, and the step of removing said lines of solidified layer, enabling horizontally spaced lines of electrode grooves to be formed on said glass substrate.

10. The method of fabricating a front substrate for AC plasma display panel according to claim 7, wherein said exposure and sand blast procedure comprises the step of printing a layer of electrode on said glass substrate over said electrode grooves after the formation of said electrode grooves, and the step of adhering a dry film photoresist to said layer of electrode, and the step of using a photo mask to perform an exposure procedure, enabling horizontally spaced lines of solidified layer to be formed on said dry film photoresist at locations for designed X-electrodes and Y-electrodes, and the step of removing the non-exposure area of said dry film photoresist, and the step of using sand blast to lithograph said glass substrate over the area not protected by said solidified layer, and the step of removing said lines of solidified layer after lithographing, and then the step of printing a protective layer on said lines of electrode layer.

11. The method of fabricating a front substrate for AC plasma display panel according to claim 7, wherein said exposure and sand blast procedure comprises the step of printing a layer of electrode on said glass substrate over said electrode grooves after the formation of said electrode grooves, and the step of printing a layer of electrode on said glass substrate over said electrode grooves, and the step of printing a protective layer on said layer of electrode, and the step of adhering a dry film photoresist to said protective layer, and the step of using a photo mask to perform an exposure procedure, enabling horizontally spaced lines of solidified layer to be formed on said dry film photoresist at locations for designed X-electrodes and Y-electrodes, and the step of removing non-exposure area of said dry film photoresist, and the step of using sand blast to lithograph said glass substrate over the area not protected by said protective layer, and the step of removing said lines of solidified layer after lithographing.

* * * * *